US005354407A

United States Patent [19]

Hubbard et al.

[11] Patent Number: 5,354,407

[45] Date of Patent: Oct. 11, 1994

[54] ENVELOPE FLAP MOISTENING APPARATUS

[75] Inventors: David W. Hubbard, Stamford; Susan E. Perrin, Seymour; Steven A. Supron, New Haven; Leo L. Wologodzew, Shelton, all of Conn.

[73] Assignee: Pitney Bowes Inc., Stamford, Conn.

[21] Appl. No.: 85,370

[22] Filed: Jul. 2, 1993

[51] Int. Cl.[5] ..... B43M 5/00

[52] U.S. Cl. ..... 156/442.1; 156/442.2

[58] Field of Search ..... 156/441.5, 442.1, 442.2, 156/442.3, 442

[56] References Cited

U.S. PATENT DOCUMENTS

| | | | |
|---|---|---|---|
| 2,243,536 | 5/1941 | Rouan et al. . | |
| 2,368,520 | 1/1945 | Burchkardt et al. . | |
| 3,905,325 | 9/1975 | Labore et al. | 156/441.5 X |
| 4,450,037 | 5/1984 | Gavronsky | 156/441.5 |
| 4,643,123 | 2/1987 | Auerbach | 156/441.5 X |
| 5,073,227 | 12/1991 | Rehberg | 156/441.5 |
| 5,217,551 | 6/1993 | Nobile et al. | 156/442.1 |
| 5,242,499 | 9/1993 | Bergman | 156/441.5 |

OTHER PUBLICATIONS

International Mailing Machines (IMS)/Hasler Technical Manual dated Jan. 1987; Cover page and pp. 110, 448–451, 454 and 455.

*Primary Examiner*—Mark A. Osele

*Attorney, Agent, or Firm*—Steven J. Shapiro; David E. Pitchenik; Melvin J. Scolnick

[57] ABSTRACT

Apparatus for supplying moisture to an envelope, having a body portion and a flap portion, the apparatus including, a substantially solid-rectangle-shaped pad made of a material capable of upwardly transferring fluid by capillary action, a device for supplying fluid to the pad, the fluid supplying device including a source of supply of fluid, the fluid supplying device including an elongate well having an elongate substantially rectangularly-shaped base wall, the well including a fluid inlet tube depending from the base wall and removably connected in fluid flow communication with the fluid supply source, the well including a pair of elongate substantially rectangularly-shaped and oppositely-spaced side walls, the well including a pair of substantially rectangularly-shaped and oppositely-spaced end walls extending between the side walls, the side and end walls extending upwardly from the base wall, the well including a plurality of upright posts located at spaced intervals longitudinally of the length of the base wall, the posts dividing the well into an elongate receptacle for receiving the pad and an elongate fluid inlet channel connected in fluid flow communication with the inlet tube, the pad removably mounted in the receptacle, a device for supporting the well, the supporting device including a bracket, and the well removably slidably connected to the bracket to facilitate disconnecting the well therefrom.

18 Claims, 4 Drawing Sheets

FLUID IN
FLUID OUT

ENVELOPE FLAP MOISTENING APPARATUS

BACKGROUND OF THE INVENTION

This invention is generally concerned with envelope flap moistening apparatus and more particularly with a mailing machine through which envelopes may be fed at different rates and including envelope flap moistening apparatus including a flap moistening brush overlaying a pad of wicking material mounted in a fluid supply well which is constructed and arranged to facilitate the appropriate transfer of fluid to and from the well over a wide range of envelope feeding rates.

In U.S. Pat. No. 4,643,123 for Envelope Flap Moistening Apparatus, issued Feb. 17, 1987 to Auerbach and assigned to the assignee of the present invention, there is disclosed an envelope feeding machine with envelope flap moistening structure including a source of supply of fluid, having a pad of wicking material mounted therein, and including a brush disposed in overlaying relationship with the supply, and thus with the pad, for transferring fluid from the supply via the pad to the brush bristles, and, when an envelope flap is fed beneath the brush bristles, for transferring fluid from the brush bristles to the envelope flap for moistening the same.

In U.S. Pat. No. 3,905,325 for Envelope Flap Moistening Apparatus, issued Sep. 16, 1975 to Labore, et. al, there is disclosed envelope flap moistening structure including a moistening blade having a fluid supply cavity formed in its upper surface, for receiving fluid from a remotely located source of supply of fluid, and having a slot extending downwardly from the fluid supply cavity to the lower surface thereof for transferring fluid from the cavity via the slot to an envelope flap when the flap is fed into engagement with the lower surface of the blade and thus across the slot, to moisten the gummed surface on the flap.

Further, on pages 110, 448–451, 454 and 455 of the International Mailing Machines (IMS)/ Hasler Technical Manual, dated January 1987, there is disclosed envelope flap moistening structure including a source of supply of moistening fluid having a well and a pad of wicking material mounted therein, wherein the pad is held in place in the well by a pad retaining member having a screen-shaped upper wall and having depending side walls connectable to the structure forming the well, and wherein the brush is removably connected to the moistening structure.

Notwithstanding the aforesaid disclosures, there has been a long felt and as yet unsatisfied need to provide envelope flap moistening structure for use in envelope feeding apparatus, which is operable at variable speeds, for moistening envelope flaps at different envelope throughput rates, wherein the flap moistening structure is constructed and arranged for appropriately, but not excessively, wetting the envelope flaps to substantially the same extent independently of the throughput rate of the envelopes. Accordingly:

an object of the invention is to provide an improved mailing machine including means for feeding an envelope, having body and flap portions, in a path of travel, and means for supplying moisture to the flap portions;

another object of the invention is to provide improved apparatus for supplying moisture to an envelope; and yet another object is to provide a mailing machine comprising envelope flap moistening apparatus including a fluid supply well, having fluid inlet and outlet channels and which is constructed and arranged for removable connection to the mailing machine.

SUMMARY OF THE INVENTION

Apparatus for supplying moisture to an envelope, having a body portion and a flap portion, the apparatus comprising, a substantially solid-rectangle-shaped pad made of a material capable of upwardly transferring fluid by capillary action, means for supplying fluid to the pad, the fluid supplying means including a source of supply of fluid, the fluid supplying means including an elongate well having an elongate substantially rectangularly-shaped base wall, the well including a fluid inlet tube depending from the base wall and removably connected in fluid flow communication with the fluid supply source, the well including a pair of elongate substantially rectangularly-shaped and oppositely-spaced side walls, the well including a pair of substantially rectangularly-shaped and oppositely-spaced end walls extending between the side walls, the side and end walls extending upwardly from the base wall, the well including a plurality of upright posts located at spaced intervals longitudinally of the length of the base wall, the posts dividing the well into an elongate receptacle for receiving the pad and an elongate fluid inlet channel connected in fluid flow communication with the inlet tube, the pad removably mounted in the receptacle, means for supporting the well, the supporting means including a bracket, and the well removably slidably connected to the bracket to facilitate disconnecting the well therefrom.

BRIEF DESCRIPTION OF THE DRAWINGS

As shown in the drawings wherein like reference numerals designate like or corresponding parts throughout the several views.

DESCRIPTION OF THE PREFERRED EMBODIMENT

Figure 1:
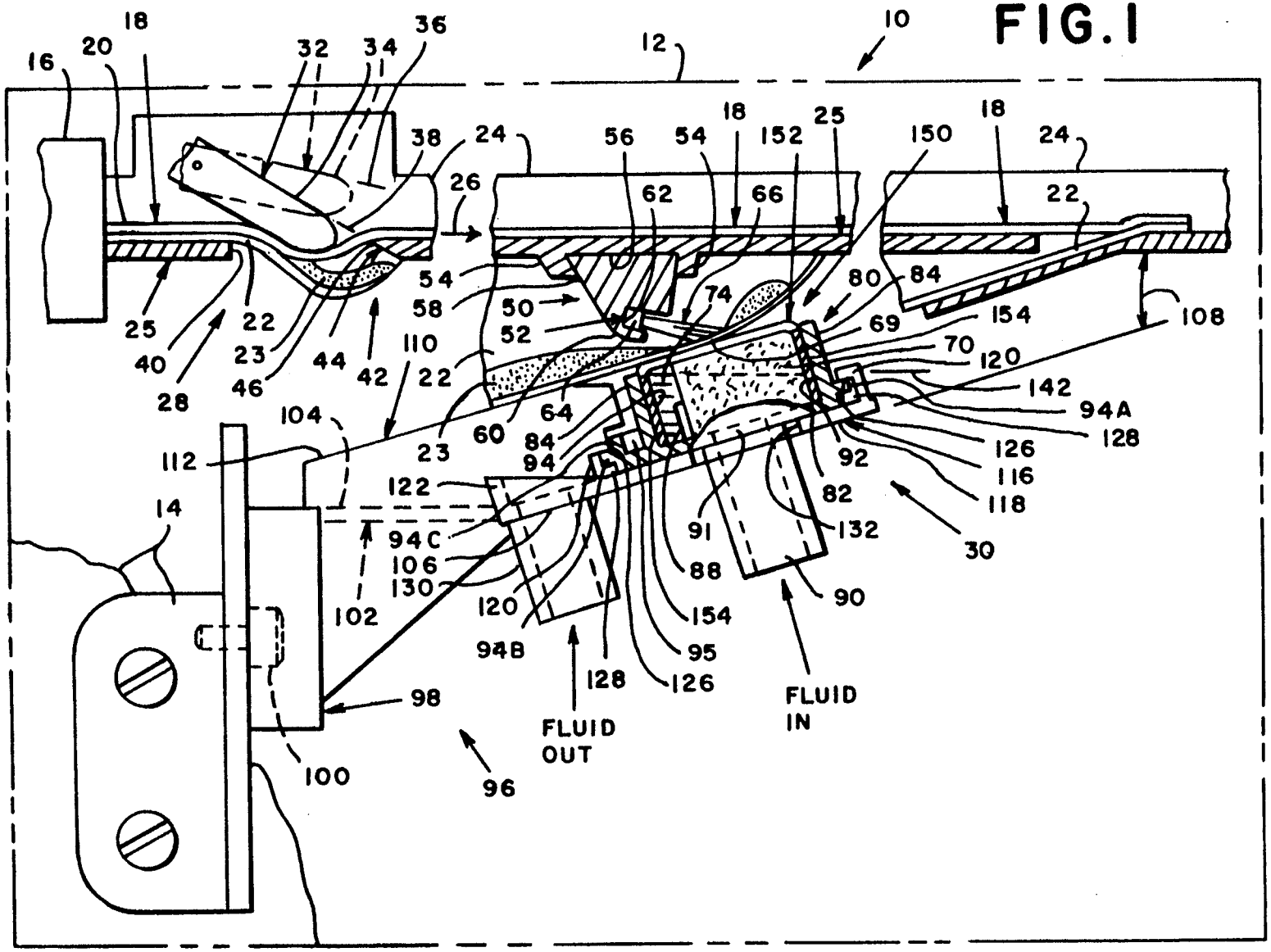
FIG. 1 is a schematic view of a mailing machine including a partially fragmented side elevation of apparatus for supplying moisture to an envelope.

As shown in FIG. 1, a mailing machine 10, of the type which may be improved in accordance with the invention, generally includes a casing 12 and framework 14 for supporting the various components of the machine 10, including the casing 12. The machine 10 includes conventional structure 16 for feeding an envelope 18, having a body portion 20, known in the art as an envelope body, and a flap portion 22, known in the art as an envelop flap, wherein the flap 22 includes a gummed, moistenable, portion 23. The machine 10 also includes a substantially vertically-extending envelope edge registration fence 24, and includes a substantially horizontally-extending deck 25 on which respective envelopes 18 urged into registration with the fence 24 are fed by the feeding structure 16 in a downstream path of travel 26 through the machine 10, via envelope flap deflecting structure 28 and envelope flap moistening structure 30.

The envelope flap deflecting structure 28 (FIG. 1) generally includes envelope guiding structure 32, including a baffle 34 which is selectively movable between one position 36, as shown by the dashed lines thereof, wherein the baffle 34 is elevated above the deck 25 to permit the passage therebetween of sealed envelopes 18 which are fed downstream in the path of travel 26 on the deck 25, and another position 38, as shown by the solid lines thereof, wherein the baffle 34 is lowered into an aperture 40 formed in the deck 25. The envelope flap deflecting structure 28 includes the deck aperture 40, and additionally includes a portion 42 of the deck 25 which is conventionally constructed and arranged to form an envelope flap deflecting blade 44, having an upstream edge 46 which extends transversely of the path of travel 26 and defines the downstream limits of the deck aperture 40. As thus constructed and arranged, when an unsealed envelope 18 is fed downstream on the deck 25, and the baffle 34 is selectively lowered into the deck aperture 40, the envelope 18 is fed into engagement with the flap deflecting blade edge 46. Whereupon the blade edge 46 deflects the envelope flap 22 beneath the deck 25 as the envelope body 20 continues to be fed downstream in the path of travel 26 on the deck 25.

Figure 3:
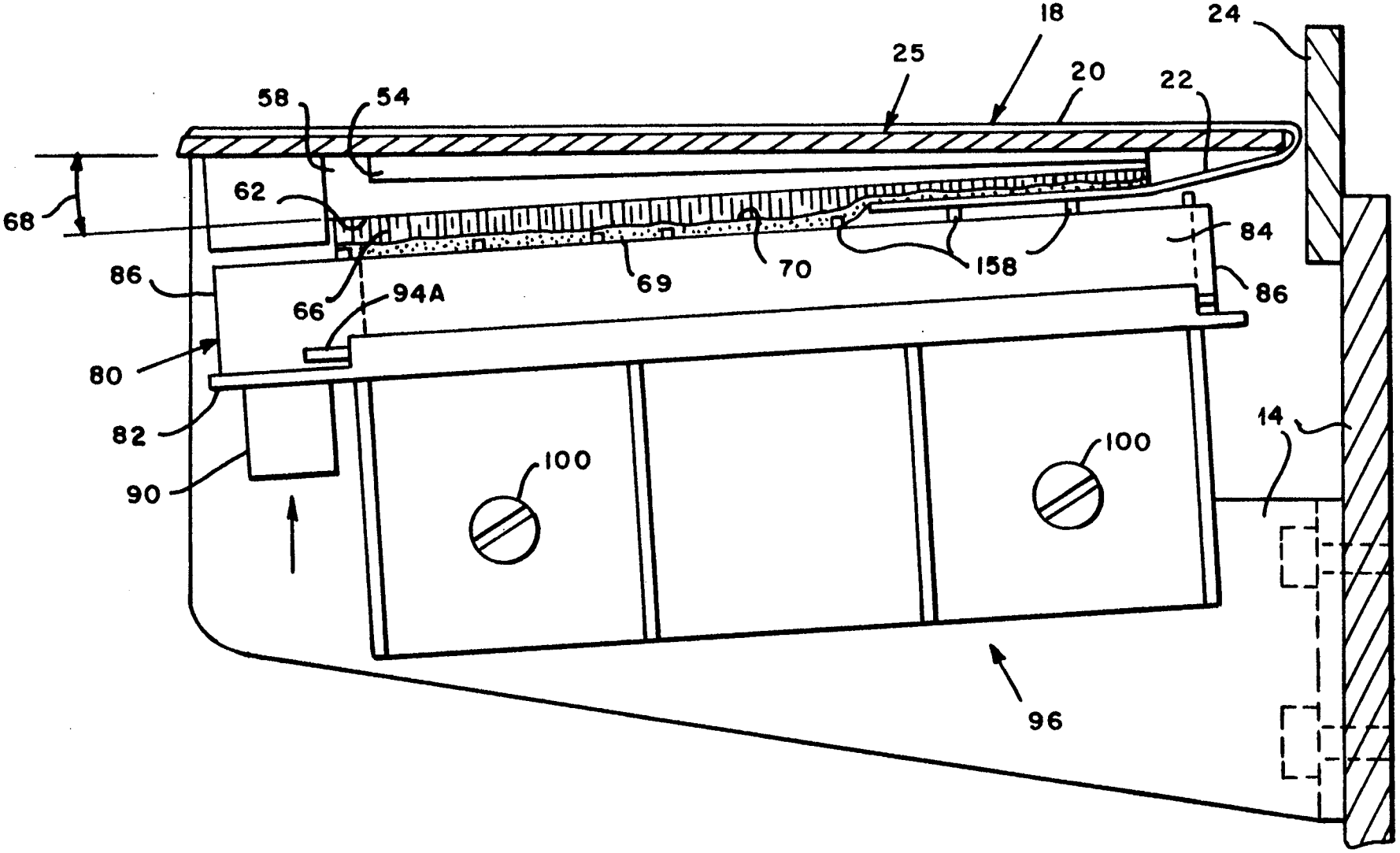
FIG. 3 is an end view of FIG. 1, showing the angular relationship between the mailing machine deck and moistening brush of the apparatus of FIG. 1.

According to the invention, the envelope flap moistening structure 30 (FIG. 1) includes brush supporting structure 50 and a suitable brush 52. The brush supporting structure 50 preferably includes a pair of elongate, oppositely spaced, finger members 54 depending from the deck 25. The finger members 54 convergedly extend towards one another and extend transversely of the path of travel 26. The finger members 54 and deck 25 preferably define an elongate channel 56, beneath the deck 25, which generally has an inverted U-shaped, transverse, cross-section. In addition, the brush supporting structure 50 includes an elongate brush supporting member 58 which is longitudinally complimentarily configured with respect to the channel 56 to removably slidably position the supporting member 58 within the channel 56 for engagement by the finger members 54, whereby the supporting member 58 may be removably slidably connected to the deck 25. As viewed when connected to the deck 25, the supporting member 58 includes an elongate lower end surface 60, which is partially curvedly shaped in transverse cross-section for guiding envelope flaps 22 which are fed thereto beneath the supporting member 58. In addition, the supporting member 58 includes an elongate channel 62 formed therein, upstream of the lower end surface 60. The brush 52 includes an elongate ferrule 64, which is longitudinally complimentarily configured with respect to the supporting member's channel 62 to removably slidably position the ferrule 64, and thus the brush 52, within the channel 62. In addition, the brush 52 includes a multiplicity of brush bristles 66 which transversely extend from the ferrule 64. The supporting member's channel 62 is preferably oriented relative to the supporting member 58 such the brush bristles 66 extend upstream of and beneath the lower surface 60 of the member 58. In addition, the supporting member's channel 62 (FIG. 3) is preferably oriented relative to the vertically-extending registration fence 24 such that the channel 62 extends transversely thereof, and thus transversely of the path of travel 26, and beneath the horizontally-extending deck 25 at an angle 68 of substantially three (3) degrees below the horizontal. As a result, when the brush 52 is slidably connected to the brush supporting member 58, the free ends 69 of the brush bristles 66 are correspondingly angulary oriented relative to the deck 25.

Further, the envelope flap moistening structure 30 (FIG. 2) preferably includes a substantially solid-rectangle-shaped pad 70 made of a material capable of upwardly transferring fluid by capillary action, such as a felted fiber, porous foam rubber or porous foam plastic material, or other fluid wicking material. Moreover, the envelope flap moistening structure 30 includes structure 72 for supplying a fluid 74, which is preferably water or water including an anti-bacterial agent, to the pad 70. The fluid supplying structure 72 includes a conventional source 76 of supply of the fluid 74, such as a conventional "chicken-feed" type water source which generally includes a suitable water bottle of the type which may be appropriately raised or lowered in a suitable support to adjust the water level therein relative to a desired water level as hereinafter discussed. In addition, the fluid supplying structure 72 includes an elongate, substantially solid-rectangle-shaped, well 80, having an elongate, substantially rectangularly-shaped, base wall 82, a pair of elongate, substantially rectangularly-shaped and oppositely-spaced, side walls 84, and a pair of elongate, substantially rectangularly-shaped and oppositely spaced, end walls 86 extending between the side walls 84. The well 80 additionally includes a fluid inlet tube 90 depending from the one end of the well's base wall 82. Preferably, the fluid inlet tube 90 is located adjacent to the well's end 91 which is most remotely located from the registration fence 24. The inlet tube 90 is normally connected in fluid flow communication with the fluid supply source 76, for example by means of a flexible tube 77 which is removably connected between the inlet tube 90 and source 76. The well's side and end walls, 84 and 86, extend upwardly from the base wall 82. In addition, the well 80 includes a plurality of upright posts 88, which are located at spaced intervals longitudinally of the length of the well's base wall 82. The posts 88 divide the well 80 into an elongate, substantially solid-rectangle-shaped, receptacle 92, which is within the well 80 for receiving the pad 70, and an elongate inlet channel 94, which is connected in fluid flow communication with the well's inlet tube 90. And, the pad 70 is normally removably mounted, as by seating, in the well's receptacle 92.

Figure 2:
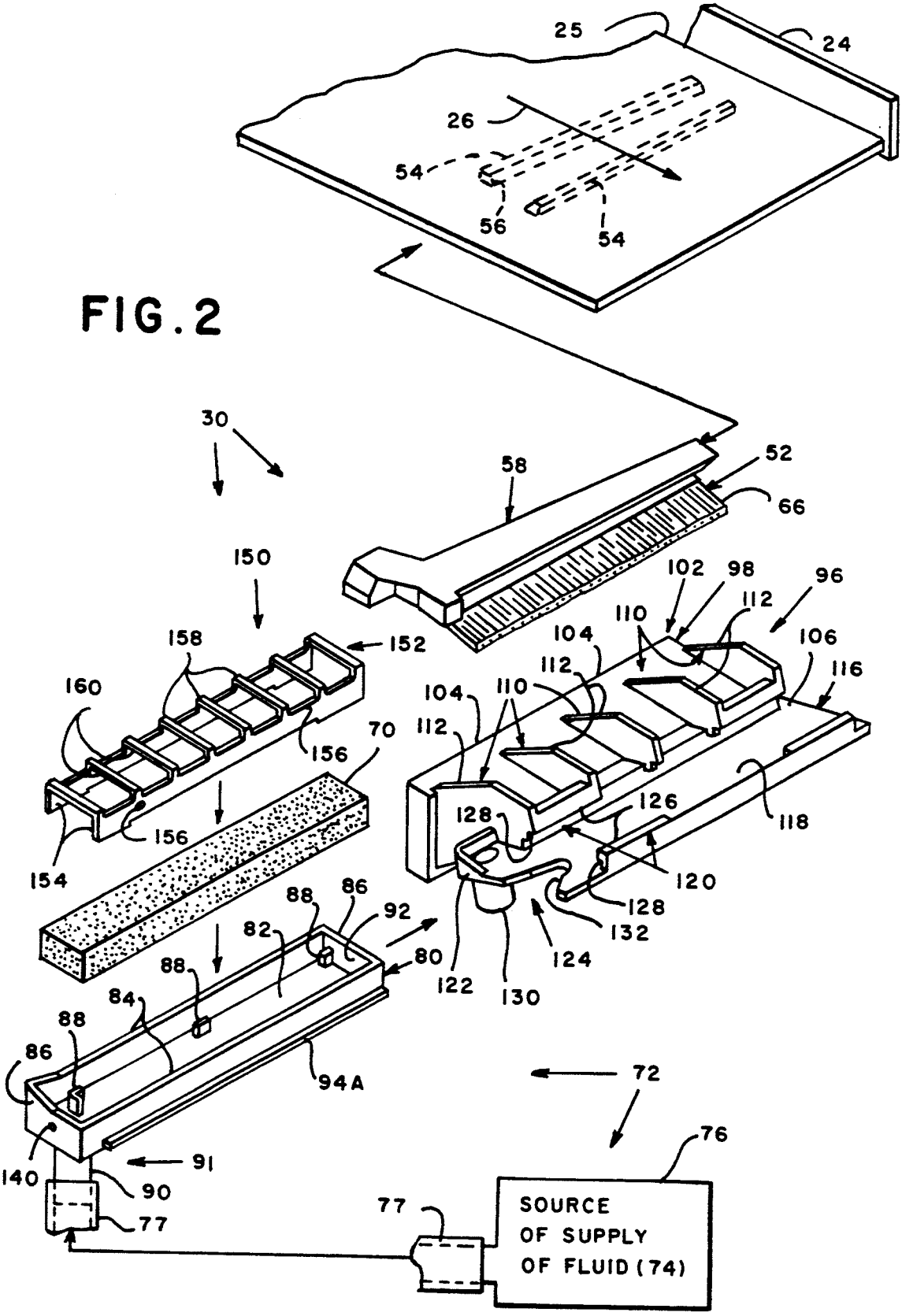
FIG. 2 is an exploded, three dimensional, view of the apparatus for supplying moisture to an envelope, as set forth in FIG. 1, including a fluid supply well having an fluid inlet channel defined therein.
Figure 4:
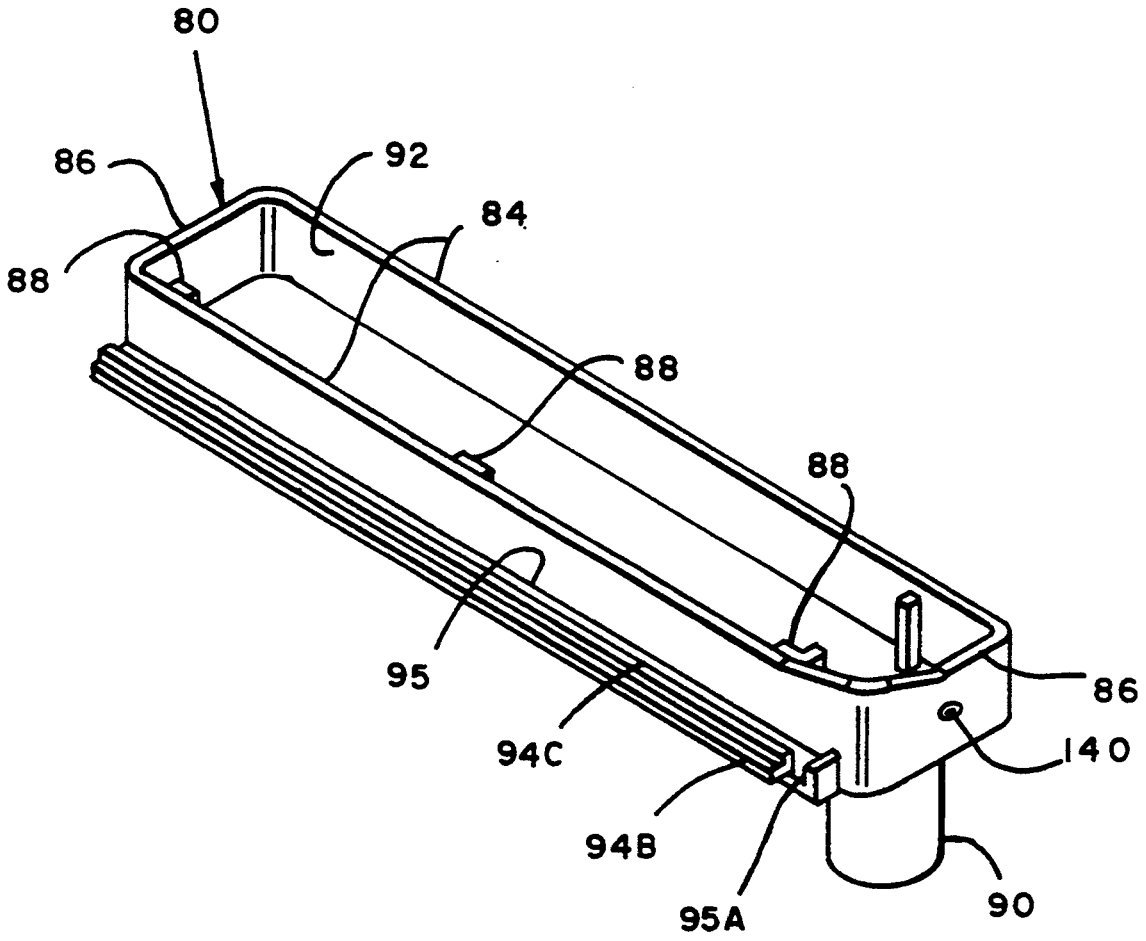
FIG. 4 is an enlarged, three-dimensional, view of the fluid supply well of FIG. 2 as seen from the opposite side thereof to show the fluid outlet channel thereof.

As shown in FIG. 2, the well's base wall 82 includes an elongate ridge portion 94A extending externally of the downstream side wall 84 and longitudinally of the length thereof. And, as shown in FIG. 4, the well's base wall 80 additionally includes an elongate ridge portion 94B extending externally of the upstream side wall 84 and longitudinally of the length thereof. Preferably, the ridge portions, 94A and 94B extend parallel to one another, and the upstream ridge portion 94B includes an upright, longitudinally-extending, element 94C which is spaced apart from the upstream side wall 84, and extends parallel to the upstream side wall 84 to form therewith an elongate fluid outlet channel 95, having an outlet opening 95A at the end thereof which is adjacent to the fluid inlet tube 90.

Moreover, the envelope flap moistening structure 30 (FIG. 2) preferably includes structure 96 for supporting the well 80, including a bracket 98 which is conventionally fixedly attached to the framework 14 (FIG. 1), as by means of a plurality of fasteners 100 so as to extend downstream therefrom beneath the deck 25. The bracket 98 includes a base wall 102 which extends downstream from the framework 14 beneath the brush supporting structure 50 and brush 52, and which extends transversely of the deck 25 and angularly thereof such that the base wall 102 (FIG. 3) is oriented substantially parallel to the brush supporting member's channel 62. The bracket's base wall 102 includes an upstream portion 104 and a downstream portion 106. Nothwithstanding the aforesaid angular transverse orientation of the bracket's base wall 102, the base wall's upstream portion 104 extends substantially horizontally downstream, and the base wall's downstream portion 106 extends both downstream and upwardly from the upstream portion 104, and thus upwardly from beneath and towards the deck 25 to form an angle 108 with respect to the horizontally-extending deck 25 of substantially sixteen (16) degrees. In addition, the bracket 98 includes a plurality of parallel-spaced, fin-shaped, elements 110 (FIG. 2), extending upwardly from the base wall's upstream portion 104 and downstream therealong. Each of the fin-shaped elements 110 (FIG. 1) includes an upper edge 112 which extends substantially parallel to the base wall's downstream portion 106, and thus downstream and upwardly towards the deck 25 at an angle of substantially sixteen (16) degrees relative to deck 25. Moreover, since the base wall 102 is angularly oriented to extend parallel to the brush supporting member's channel 62, the fin-shaped elements' uppers edges 112 extend downstream towards the brush bristles 66 for guiding envelope flaps 22 fed thereto beneath the brush bristles 66. Further, the bracket 98 includes a tray 116 (FIG. 2), which includes a bottom wall 118 defined by the bracket base wall's downstream portion 106, a pair of elongate, oppositely-spaced, substantially parallel, upright walls 120, and an end wall 122 which extends between the upright walls 120 at the tray's end 124 which is most remotely spaced from the registration fence 24. Preferably, the upper edges 126 of the tray's upright walls 120 partially extend towards one another, to define with the tray's bottom wall 118 a pair of elongate, parallel, oppositely spaced, channels 128, which extend transversely of the path of travel 26 beneath the brush bristles 66. In addition, the channels 128 and the well ridges portions, 94A and 94B, are preferably complementarily configured to permit the well 80 to be longitudinally slidably mounted within the tray 116, whereby the well 80 is removably slidably connectable to the bracket 98. Moreover, the tray 116, and thus the bracket 98, includes a fluid outlet tube 130 depending from the tray's end 124 which is most remotely spaced from the registration fence 24. And, to accommodate receiving the well's inlet tube 90, the tray 116 preferably includes a slot 132 formed inwardly thereof from the tray's end 124 which is most remotely spaced from the registration fence 24.

As shown in FIG. 1, when the well 80 is longitudinally removably slidably connected to the bracket 98, the well's inlet tube 90 extends into the tray's slot 132 and depends below the tray 116, and thus below the bracket 98, to permit manually grasping the depending tube 90 for removal of the well 80 from the tray 116, and thus from the bracket 98. Moreover, the well's depending inlet tube 90 may be manually grasped for removably mounting the well 80 on the bracket 98. Further, when the well 80 is connected to the bracket 98, the well's fluid outlet channel 95 is connected in fluid flow communication with the bracket's fluid outlet tube 130, via the channel opening 95A (FIG. 4), for guiding fluid overflow from the well 80 (FIG. 1) away from the bracket 98, and thus away from the well 80. Further, when the well 80 is connected to the bracket 98, the pad 70 is disposed directly beneath and in contact with the brush bristle's free ends 69. Or, otherwise stated, the brush bristles 66 are disposed in overhanging relationship and in contact with the pad 70.

As shown in FIG. 2, the well 80 preferably includes a desired fluid level mark 140, located substantially centrally of the well end 91. When conventionally adjusting the fluid level within the well 80 (FIG. 1), as by suitably raising or lowering the fluid bottle of the fluid supply source 76 (FIG. 2), the fluid level within the well 80 is preferably adjusted to the level of the mark 140, whereby the fluid in the well 80 (FIG. 1) is adjusted to a desired fluid level 142. In the course of adjusting the level of fluid 74 within the well 80 to the desired fluid level 142, excess fluid 74 may overflow the upstream side wall 84 of the well 80. Whereupon, the overflow fluid 74 is guided by the well's fluid outlet channel 95 to the bracket's outlet tube 130 and thus away from the well 80 and bracket 98. The overflow fluid 74 is thus drained from the well's outlet channel 95 via the bracket's outlet tube 130 due to the angular orientation of the bracket's base wall 102 corresponding to that of the brush supporting member's channel 62, i.e., the outlet channel 95 tranversely extends beneath the deck 25 at an angle of substantially three (3) degrees from the horizontal as measured from the vertically oriented registration fence 24. When the level of fluid 74 within the well 80 is at the desired fluid level 142, as indicated by the mark 140, the fluid 74 is also at the upper edge of the well's upstream side wall 84, and thus at a depth adjacent to the well's upstream side wall 84 sufficient to substantially completely fill the well's inlet channel 94. And, since the fluid 74 within the well's inlet channel 94 extends longitudinally of the length of the pad 70, the pad 70 is provided with a continuous supply of fluid 74 independently of the speed at which envelopes 18 are fed through the machine 10. In this connection it is noted that due to the outlet channel 95 being angularly oriented to accommodate drainage of overflow fluid 74 therefrom, the inlet channel 94 is correspondingly angularly oriented. As a result of which the longitudinal length of the pad 70 is not uniformly moistened with fluid from the inlet channel 94. Accordingly, the aforesaid three (3) degree angular orientation of the brackets base wall 102 and well's inlet channel 94 is a critical tolerance. Accordingly, the envelope flap moistening structure 30 is constructed and arranged for appropriately moistening envelope flaps 22 substantially independently of the number of envelopes 18 per unit of time at which envelopes 18 are fed through the machine 10, i.e., substantially independently of the envelope throughput rate of the machine 10.

Still further, the envelope flap moistening structure 30 (FIG. 2) includes a pad retainer member 150 including an elongate, substantially rectangularly-shaped, screen-shaped, upper wall 152. The retainer member 150 also includes a pair of elongate, substantially rectangularly-shaped, side walls 154 depending from the upper wall 152. The side walls 154 each include a plurality of protrusions 156 extending outwardly thereof, which are located at spaced intervals along the side walls 154. Preferably, the side' walls 154 are spaced from one another slightly less than the distance which the oppositely spaced well's side walls 84 are spaced from one another, for providing an interference fit between the side wall protrusions 156 and well side walls 84 when the member's side walls 154 are removably mounted within the well 80 for retaining the pad 70 in place therewithin. Although one of the member's side walls 154 is disposed within the well's fluid inlet channel 94 when the pad retaining member 150 is thus removably connected to the well 80, the reduction in transverse cross-section of the inlet channel 94 is negligible due to the pad retaining member 150 being fabricated from narrow gauge sheet metal. Preferably, the screen-shaped upper wall 152 comprises a plurality of elongate, generally rectangularly-shaped, portions 158, extending between the member's side walls 156 at spaced intervals longitudinally of the lengths thereof. Accordingly, when the member 150 is removably connected to the well 80, the member's upper wall 152 defines a plurality of substantially rectangularly-shaped apertures 160, located at spaced intervals longitudinally of the length of the well 80, into which the brush bristles 66 (FIG. 1) extend for disposition in engagement with the pad 70. As thus constructed and arranged, fluid 74 from the pad 70 (FIG. 3) is transferred upwardly by capillary action to the brush bristles 66, when an envelope flap 22 is .not being fed therebetween, and fluid 74 from the brush bristles 66 is transferred downwardly, under the influence of gravity, from the brush bristles 66 to the envelope flap's gummed portion 23 (FIG. 2), for moistening thereof, when an envelope flap 22 is fed beneath the brush bristles 66, and thus between the brush bristles 66 and pad 70.

What is claimed is:

1. Apparatus for supplying moisture to an envelope, having a body portion and a flap portion, the apparatus comprising:

(a) a substantially solid-rectangle-shaped pad made of a material capable of upwardly transferring fluid by capillary action;

(b) means for supplying fluid to the pad, the fluid supplying means including a source of supply of fluid, the fluid supplying means including an elongate well having an elongate substantially rectangularly-shaped base wall, the well including a fluid inlet tube depending from the base wall and removably connected in fluid flow communication with the fluid supply source, the well including a pair of elongate substantially rectangularly-shaped and oppositely spaced side walls, the well including a pair of substantially rectangularly-shaped and oppositely-spaced end walls extending between the side walls, the side and end walls extending upwardly from the base wall, the well including a plurality of upright posts located at spaced intervals longitudinally of the length of the base wall, the posts dividing the well into an elongate receptacle for receiving the pad and an elongate fluid inlet channel connected in fluid communication with the inlet tube, the pad removably mounted in the receptacle;

(c) means for supporting the well, the supporting means including a bracket, the well and fluid inlet channel being supported so as to be at an angle across the well and channel of about three (3) degrees from horizontal and the well removably slidably connected to the bracket to facilitate disconnecting the well therefrom, the depending inlet tube extending beneath the bracket to permit manual grasping thereof to permit slidable movement and the bracket including a base wall section to which the well is removably slidably connected, the base wall including a fluid outlet tube depending therefrom for guiding fluid overflow from the well away therefrom.

2. The apparatus according to claim 1 including a pad retaining member, the member including a screen-shaped upper wall, the member including oppositely spaced side walls depending from the upper wall and removably connected to the well's side walls for disposing the member's upper wall in overlying relationship with the pad, and one of the member's side walls disposed in the fluid inlet channel.

3. The apparatus according to claim 1 including a brush, and the brush including bristles disposed in overlaying relationship with the pad for transferring fluid by capillary action from the pad to the brush bristles.

4. The apparatus according to claim 2 including a brush, and the brush including bristles disposed in overlaying relationship with the member's upper wall and thus with the pad for transferring fluid by capillary action from the pad to the brush bristles.

5. The apparatus according to claim 1, wherein the well's base wall and one of the well's side walls define an elongate fluid outlet channel externally of the well for receiving fluid overflow from the well, and the outlet channel angularly connected in fluid flow communication with the fluid outlet tube when the well is connected to the bracket's base wall portion for guiding fluid overflow from the well to the outlet tube.

6. The apparatus according to claim 3 in combination with a deck for guiding the envelope in a path of travel, the deck including means for deflecting the envelope flap portion out of the path of travel and towards the brush, means for supporting the brush, the supporting means removably slidably connected to the deck to facilitate disconnecting the supporting means and thus the brush.

7. The apparatus according to claim 4 in combination with a deck for guiding the envelope flap portion toward the brush, means for supporting the brush, the supporting means removably slidably connected to the deck to facilitate disconnecting the supporting means and thus the brush.

8. The apparatus according to claim 6, wherein the brush supporting means depends from the deck and includes a curvedly-extending lower surface for guiding the envelope flap portion therebeneath and into engagement with the brush bristles for transferring moisture from the bristles to the flap portion, and the brush removably slidably connected to the supporting means to facilitate disconnecting the brush.

9. The apparatus according to claim 7, wherein the brush supporting means depends from the deck and includes a curvedly-extending lower surface for guiding the envelope flap therebeneath and into engagement with the brush bristles for transferring moisture from the bristles to the flap, and the brush removably slidably connected to the supporting means to facilitate disconnecting the brush.

10. A mailing machine comprising: a deck; means for feeding an envelope, having a body portion and a flap portion, in a downstream path of travel; and means for supplying moisture to the flap portion including:

(a) a substantially solid-rectangle-shaped pad made of a material capable of upwardly transferring fluid by capillary action;

(b) means for supplying fluid to the pad, the fluid supplying means including a source of supply of fluid, the fluid supplying means including an elongate well having an elongate substantially rectangularly-shaped base wall, the well including a fluid inlet tube depending from the base wall and a flexible tube extending from the source of supply of fluid removably connected to the input tube for fluid flow communication with the fluid supply source, the well including a pair of elongate substantially rectangularly-shaped and oppositely spaced side walls, the well including a pair of substantially rectangularly-shaped and oppositely-spaced end walls extending between the side wall, the side and end walls extending upwardly from the base wall, the well including a plurality of upright posts located at spaced intervals longitudinally of the length of the base wall, the posts dividing the well into an elongate receptacle for receiving the pad and an elongate fluid inlet channel connected in fluid communication with the inlet tube, the pad removably mounted in the receptacle;

(c) means for supporting the well, the supporting means including a bracket, the well and fluid inlet channel being supported so as to be at an angle across the well and channel of about three (3) degrees from horizontal and the well removably slidably connected to the bracket to facilitate disconnecting the well therefrom, the depending inlet tube extending beneath the bracket to permit manual grasping thereof for slidable movement and the bracket including a base wall section to which the well is removably slidably connected, the base wall section including a fluid outlet tube depending therefrom for guiding fluid overflow from the well away therefrom.

11. The mailing machine according to claim 10 including a pad retaining member, the member including a screen-shaped upper wall, the member including oppositely spaced side walls depending from the upper wall and removably connected to the well's side wall for disposing the member's upper wall in overlying relationship with the pad, and one of the member's side walls disposed in the fluid inlet channel.

12. The mailing machine according to claim 10 including a brush, and the brush including bristles disposed in overlaying relationship with the pad for transferring fluid by capillary action from the pad to the brush bristles.

13. The mailing machine according to claim 11 including a brush, and the brush including bristles disposed in overlaying relationship with the member's upper wall and thus with the pad for transferring fluid by capillary action from the pad to the brush bristles.

14. The mailing machine according to claim 12, wherein the well's base wall and one of the well's side walls define an elongate fluid outlet channel externally of the well for receiving fluid overflow from the well, and the outlet channel angularly connected in fluid flow communication with the fluid outlet tube when the well is connected to the bracket's base wall portion for guiding fluid overflow from the well to the outlet tube.

15. The mailing machine according to claim 12, wherein the deck includes means for guiding the envelope flap portion out of the path of travel and towards the brush, means for supporting the brush, the supporting means removably slidably connected to the deck to facilitate disconnecting the supporting means and thus the brush.

16. The mailing machine according to claim 13, wherein the deck includes means for guiding the envelope flap portion out of the path of travel and towards the brush, means for supporting the brush, the supporting means removably slidably connected to the deck to facilitate disconnecting the supporting means and thus the brush.

17. The mailing machine according to claim 15, wherein the brush supporting means depends from the deck and includes a curvedly-extending lower surface for guiding the envelope flap portion therebeneath and into engagement with the brush bristles for transferring moisture from the bristles to the flap portion, and the brush removably slidably connected to the supporting means to facilitate disconnecting the brush.

18. The mailing machine according to claim 16, wherein the brush supporting means depends from the deck and includes a curvedly-extending lower surface for guiding the envelope flap portion therebeneath and into engagement with the brush bristles for transferring moisture from the bristles to the flap portion, and the brush removably slidably connected to the supporting means to facilitate disconnecting the brush.

* * * * *